United States Patent [19]

Vondernau et al.

[11] Patent Number: 4,696,264

[45] Date of Patent: Sep. 29, 1987

[54] TWO-STROKE ENGINE

[75] Inventors: Werner Vondernau, Backnang-Waldrems; Jürgen Weber, Kernen-Rommelshausen; Hans Nickel, Cottenweiler; Michael Wissmann, Schorndorf-Weiler; Harald Schliemann, Waiblingen, all of Fed. Rep. of Germany

[73] Assignee: Andreas Stihl, Waiblingen, Fed. Rep. of Germany

[21] Appl. No.: 764,220

[22] Filed: Aug. 9, 1985

Related U.S. Application Data

[63] Continuation-in-part of Ser. No. 704,083, Feb. 21, 1985, Pat. No. 4,590,896.

[30] Foreign Application Priority Data

Mar. 16, 1985 [DE] Fed. Rep. of Germany ..... 3509540

[51] Int. Cl.[4] ..... F02B 33/04

[52] U.S. Cl. ..... 123/73 V; 123/378

[58] Field of Search ..... 123/73 R, 73 V, 378, 123/389, 391, 65 R

[56] References Cited

U.S. PATENT DOCUMENTS

| | | | |
|---|---|---|---|
| 2,431,182 | 11/1947 | Mallory | 123/389 |
| 2,627,850 | 2/1953 | Willim | 123/389 |
| 3,707,143 | 12/1972 | Reese et al. | 123/65 A |
| 3,999,622 | 12/1976 | Reed | 123/378 |
| 4,323,040 | 4/1982 | Block | 123/389 |
| 4,590,896 | 5/1986 | Wissmann et al. | 123/73 R |

*Primary Examiner*—Craig R. Feinberg
*Assistant Examiner*—David A. Okonsky
*Attorney, Agent, or Firm*—Walter Ottesen

[57] ABSTRACT

A two-stroke engine is disclosed which is controlled by a carburetor throttle valve and has a crankcase subjected to continuously alternating overpressure and underpressure. A pneumatic control member responsive to a signal dependent on the rotational speed of the engine is in pressure communication with the inner chamber of the crankcase via a valve. The output member of the pneumatic control member is connected with the throttle flap of the carburetor. The valve provided between the crankcase and the pneumatic control member is responsive to a signal for controlling the pressure in the pneumatic control member. This valve can be configured as a resonance control valve fixedly mounted to the housing of the engine. The resonance control valve has a mass oscillator which, at a correspondingly high engine speed and as a result of the vibration frequency associated therewith, acts upon a sealing diaphragm in the resonance control valve to open a pass-through opening communicating with the pneumatic control member.

9 Claims, 6 Drawing Figures

TWO-STROKE ENGINE

RELATED APPLICATION

This is a continuation-in-part of patent application Ser. No. 704,083, filed Feb. 21, 1985 and which has issued as U.S. Pat. No. 4,590,896. U.S. Pat. No. 4,590,896 and this application are assigned to the same assignee.

FIELD OF THE INVENTION

The invention relates to a two-stroke engine equipped with a carburetor controlled by means of a throttle flap and a crankcase subjected to continuously alternating conditions of underpressure and overpressure. A control system limits a control quantity of the engine such as rotational speed.

BACKGROUND OF THE INVENTION

The invention relates to a two-stroke engine equipped with a carburetor controlled by a throttle flap. In two-stroke engines of the above-mentioned type, the reciprocating motion of the piston subjects the crankcase to a continuous change between overpressure and underpressure. The invention is based on the realization that these pressure or oscillation relationships in the crankcase of a two-stroke engine can be made use of, especially by separating the overpressure waves from the underpressure waves in the crankcase, in order to provide a pneumatic auxiliary system for servo functions, in particular for controlling or limiting the engine speed to protect the engine or its parts from overload.

SUMMARY OF THE INVENTION

The two-stroke engine of the invention is equipped with a control device to control an operating condition of the engine such as speed. The two-stroke engine includes: a crankcase subjected to continuously alternating underpressure and overpressure conditions; signal means for providing a signal indicative of a predetermined value of said operating condition of the engine to be controlled; an output actuator connected to the control device of the engine for adjusting said condition; pneumatic actuating means responsive to a change in pressure therein for acting on the output actuator so as to cause the latter to adjust the position of said control device to control said condition; pressure connecting means for connecting the pneumatic actuating means to the crankcase; and, valve means responsive to the signal for acting on the pressure connecting means so as to cause said pressure change to occur in the pneumatic actuating means.

According to another embodiment of the invention, the two-stroke engine provides an unambiguous close-tolerance signal indicative of the engine speed via the valve for the control of the pneumatic control member.

The two-stroke engine of this embodiment of the invention has a predetermined resonance frequency and is equipped with a carburetor controlled by a throttle flap. The two-stroke engine includes a crankcase subjected to continuously alternating underpressure and overpressure conditions; an output actuator connected to the throttle flap of the engine for adjusting the speed thereof; pneumatic actuating means responsive to a change in pressure therein for acting on the output actuator so as to cause the latter to adjust the position of the throttle flap thereby changing the speed of the engine; pressure connecting means for connecting the pneumatic actuating means to the crankcase; and, resonance valve means connected into the pressure conduit means for opening the latter in response to a predetermined resonance frequency thereby subjecting the pneumatic actuating means to one of the pressure conditions and causing a pressure change therein.

Preferred embodiments and improvements as well as further advantages and essential details of the invention will become apparent from the subsequent description and the drawing schematically illustrating preferred embodiments by way of example.

BRIEF DESCRIPTION OF THE DRAWING

The invention will now be described with reference to the drawing wherein.

DESCRIPTION OF THE PREFERRED EMBODIMENTS OF THE INVENTION

Figure 1:
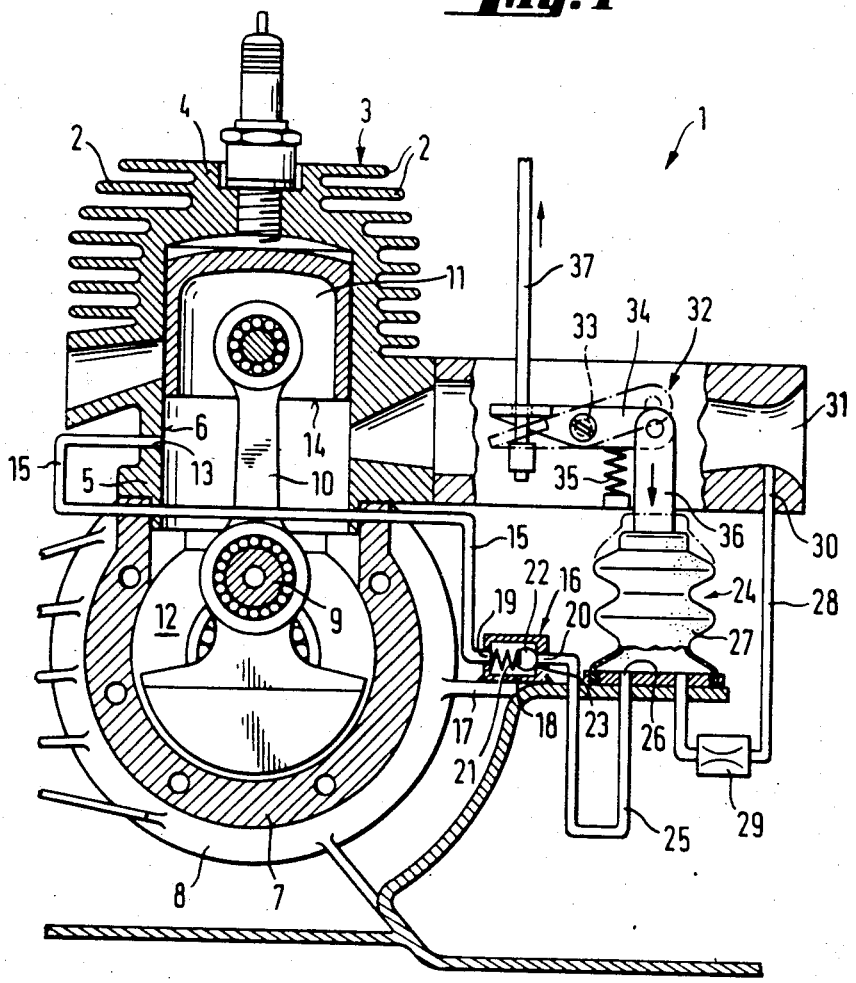
FIG. 1 is a side elevation view, partially in section, of a two-stroke engine with a vacuum-operated speed-control apparatus.

The two-stroke engine 1 illustrated in the drawing includes a cylinder 3 provided with cooling ribs 2. The lower part 5 of the cylinder wall 6 is at the opposite end of the cylinder head 4 and is adjacent to a wall 7 of the crankcase 8. A crankshaft 9 is rotatably journalled in bearings in the crankcase 8 and has a connecting rod 10 and piston 11 assembly pivotally connected thereto. The piston 11 reciprocates in the cylinder within a predetermined stroke. The piston 11 is shown at top dead center. The reciprocating motion of piston 11 produces different pressure waves in the inner chamber 12 of the crankcase 8, with underpressure alternating with overpressure.

In the embodiment of FIG. 1, a bore 13 is provided in the lower part 5 of the wall 6 of cylinder 3. Bore 13 is positioned such that it is overtraveled by piston 11 as the latter moves towards top dead center in cylinder 3. Thus, the bottom edge 14 of piston 11 is above bore 13 which is thus open and communicates with inner chamber 12 of crankcase 8.

Connected to bore 13 in wall 6 of cylinder 3 is a pressure line 15 which leads to a commercially available vibration valve 16 responsive to speed vibrations of the two-stroke engine 1. A bracket 17 fixedly connects vibration valve 16 with wall 7 of crankcase 8 so that the vibrations of the latter are directly transmitted to vibration valve 16 undampened. When these vibrations reach a predetermined frequency or acceleration amplitude, valve 16 will open as a result of these vibrations.

Vibration valve 16 has a housing 18 with an inlet port 19 and an outlet port 20. Housing 18 accommodates a helical spring 21 bearing against a ball 22. Ball 22 serves as a sealing member and is pressed by spring 21 into sealing engagement with a valve seat 23 disposed at outlet port 20 in the vibration valve 16 of FIGS. 1 and 2. Pressure line 15 is configured as a hollow conduit and is connected to inlet port 19 of housing 18.

Figure 2:
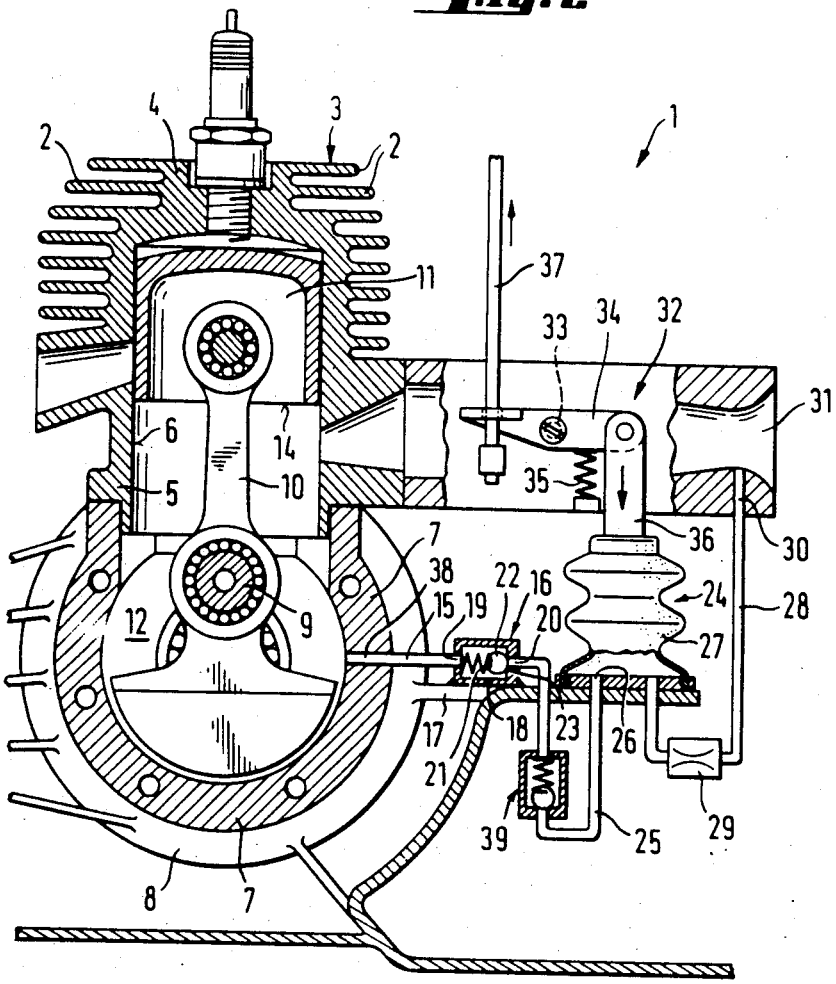
FIG. 2 is also a side elevation view of the two-stroke engine of FIG. 1, showing another embodiment of a vacuum-operated speed-control apparatus.

In the embodiments of FIGS. 1 and 2, a pneumatic controlling member 24 responsive to underpressure is arranged behind vibration valve 16 and is coupled thereto via a control line 25 which connects outlet port 20 of vibration valve 16 with an inlet 26 of pneumatic controlling member 24. In these embodiments, pneumatic controlling member 24 is configured as a bellows 27 which may be made of rubber or plastic material. Instead of the bellows configuration, pneumatic controlling member 24 may also be a piston-and-cylinder assembly in which the piston is axially displaced in the pneumatic cylinder in a known manner when a change in pressure occurs.

In addition, a vent line 28 including an air-flow throttle 29 is provided. Vent line 28 is connected to a transverse bore 30 opening into a carburetor venturi 31. The other end of vent line 28 is connected to control line 25 via bellows 27.

An output actuator 32 is at the end of the bellows 27 of FIGS. 1 and 2 opposite inlet 26. The output actuator 32 is configured as a throttle flap control lever 34 pivotable about an axis 33. Throttle flap control lever 34 coacts with a spring element 35 acting in the opening direction of the throttle flap (not shown) of a carburetor (not shown). One end of throttle flap control lever 34 is pivotally connected to bellows 27 via a connecting lever 36 arranged at substantially right angles to lever 34. A tie rod 37 permitting manual operation of the throttle flap valve is arranged at the other end of throttle flap control lever 34. When tie rod 37 is actuated in the direction of the arrow, the throttle flap will be closed, accompanied by compression of bellows 27. If the tie rod is actuated in a direction opposite to the direction of the arrow, the throttle flap valve will be released and is opened by means of the force of spring 35.

By contrast with the embodiment of FIG. 1, the embodiment of FIG. 2 includes a bore 38 provided in wall 7 of crankcase 8. Hollow line 15 leading to vibration valve 16 is connected to this bore 38 thereby establishing a permanent connection with the inner chamber 12 of crankcase 8 which is independent of the piston stroke. As a result, vibration valve 16 is continuously exposed to the alternating pressure (overpressure and underpressure) occurring in the inner chamber 12 of crankcase 8. To shut off overpressure waves, a rectifier valve 39 is provided which in this embodiment is configured as a spring-loaded ball check valve and arranged in control line 25 downstream of vibration valve 16. It is also possible to arrange rectifier valve 39 upstream of vibration valve 16, thus positioning it in the hollow line 15 between bore 38 of crankcase 8 and inlet port 19 of vibration valve 16.

In the two-stroke engine 1 shown in FIG. 1, a partial vacuum or underpressure exists during the entire time that bore 13 is open so that, with the engine running, a permanent underpressure is built up in conduit 15 leading to vibration valve 16 fixedly secured with crankcase 8. If the speed of the two-stroke engine 1 exceeds the speed to be controlled, the engine housing and consequently the vibration valve 16 will be subjected to such high vibrations that the vibration valve 16 will open. In this event, the valve ball will lift clear of its valve seat 23 which is accomplished because its mass moment of inertia is adjusted to the limit speed (speed limit beyond which the control functions). If the speed to be controlled exceeds this limit, a suitably large acceleration is imparted to the ball, causing it to lift clear of its seat 23 and open the valve. As a result, a connection is established between conduit 15 and control line 25. The underpressure building up in control line 25 will act on bellows 27, causing it to contract and move throttle flap control lever 34 in the closing direction of the throttle flap.

The speed of the two-stroke engine 1 thus throttled will then drop below the limit speed, so that vibration valve 16 will again close. With vibration valve 16 closed, air-flow throttle 29 which is configured so as not to disturb the buildup of underpressure in bellows 27 while vibration valve 16 is open, will then admit air into bellows 27, causing it to expand and to open the throttle flap again. On a time average, the engine will thus be adjusted to the desired control speed. Transverse bore 30 in carburetor venturi 31 is provided for ventilation. As a result, on commencement of the control function when the throttle flap is still open and the underpressure in crankcase 8 is accordingly still low, a pre-underpressure will be present at air-flow throttle 29 because of the high speed of the inducted air in carburetor venturi 31 under these conditions. This pre-underpressure at air-flow throttle 29 and in vent line 28 assists the formation of underpressure in bellows 27.

In the two-stroke engine 1 illustrated in FIG. 2, the underpressure is produced with aid of rectifier valve 39. Rectifier or check valve 39 charges the control line 25 only with the underpressure waves of crankcase 8. It closes in the presence of overpressure, thus inhibiting the passage of overpressure waves occurring in crankcase 8 to control line 25 and bellows 27. Thus, with a suitable amount of underpressure applied, bellows 27 causes throttle flap control lever 34 to move in the closing direction (direction of arrow on connecting member 36) as in the embodiment previously described.

Figure 3:
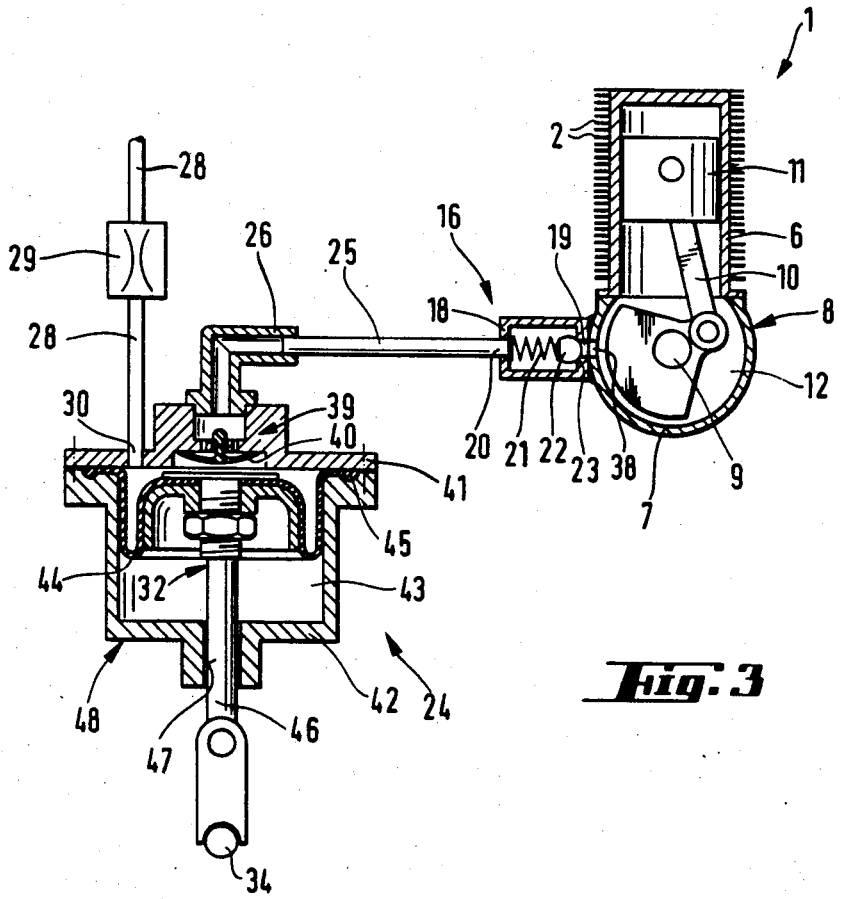
FIG. 3 is a side elevation view of a speed-control apparatus, operable by overpressure of the two-stroke engine similar to FIGS. 1 and 2.

In the embodiment illustrated in FIG. 3 which operates with overpressure, vibration valve 16 is again fixedly secured with the crankcase 8, yet mounted in reverse position. This means that valve seat 23 against which the ball-shaped sealing member 22 rests under the load of spring 21 is disposed at inlet port 19 of housing 18. Thus, helical spring 21 in housing 18 bears with on end against outlet port 20 from which control line 25 extends to mushroom-shaped valve 40 which is configured as a rectifier valve 39. The configuration and arrangement of mushroom valve 40 are such that it opens only in the presence of overpressure waves of crankcase 8.

Mushroom valve 40 is arranged in a cap 41 which seals a cup-shaped housing 42. Chamber 43 of cup-shaped housing 42 accommodates a roll diaphragm 44 the outer circumferential edge 45 of which is clamped seal-tight between cap 41 and the rim of cup-shaped housing 42. For ventilation, a transverse bore 30 is provided in cap 41 and communicates with vent line 28 which includes air-flow throttle 29. A control rod 46 is fastened to roll diaphragm 44 and extends out of a passageway 47 at the end of cup-shaped housing 42 opposite cap 41. Control rod 46 of diaphragm stroke sensor 48 serves to change the position of a throttle flap of the two-stroke engine.

Because, with vibration valve 16 open, rectifier valve 39 allows only the passage of overpressure waves of crankcase 8, the control of the throttle flap via diaphragm stroke sensor 48 is substantially accomplished as in the previously described embodiments; however, the direction is reversed because roll diaphragm 44 will expand in the presence of an overpressure in housing chamber 43, causing the throttle flap to change position in the direction of closing. A bellows or a piston-and-cylinder assembly may be substituted for the roll diaphragm 44. Also, the check or rectifier valve 39 may be arranged either upstream or downstream of vibration valve 16.

The invention thus provides an advantageous control system which, utilizing the pressure waves occurring in crankcase 8, is configured as an auxiliary system for applications requiring control forces, particularly speed governors, whereby a pneumatic pressure is available for servo functions.

In the speed control system described by way of example, vibration valve 16 is opened in dependence on acceleration and consequently in dependence on the rotational speed. In this system, the throttle flap of the carburetor is adjusted in the closing direction so that a closed control loop for speed control is obtained. It is also possible to provide a valve operated by centrifugal force as control valve and arrange the same in the crank web, for example.

The invention affords the significant advantage of avoiding a running up of the two-stroke engine 1 beyond a predetermined speed, even if the fuel is short. Because the control is accomplished by throttling the inducted air-fuel mixture, significant fuel savings can be realized compared to other control methods which are based on enriching the mixture or turning off the ignition.

The invention can also be realized by substituting another valve configuration, for example, a commercially available electropneumatic or solenoid valve, or the like, for the vibration valve 16 described. This valve may receive its opening signal not through mechanical vibrations transmitted via its fastening to the engine housing, particularly to the crankcase or another vibrating part as is the case with the vibration valve, but from the ignition system, for example, particularly an electronic ignition system. This signal may be an electrical signal, such as an electric voltage, issued, for example, by the ignition device at a specific engine speed. The electropneumatic valve or the solenoid valve will then open on receiving this signal, thereby opening the pressure connection between the crankcase and the pneumatic controlling member 24 as described with reference to the embodiment of the vibration valve. This enables the output actuator 32, 46 connected to this pneumatic controlling member 24 to close the carburetor throttle flap when a predetermined speed is attained.

The signal issuing, for example, from the electronics of the ignition system is likewise suitably delivered above the operating speed of the engine so that in a power saw or a cutter, for example, the engine speed is automatically reduced prior to reaching a critical speed and without operator intervention, in order to positively preclude damage to the machine or parts thereof.

Figure 4:
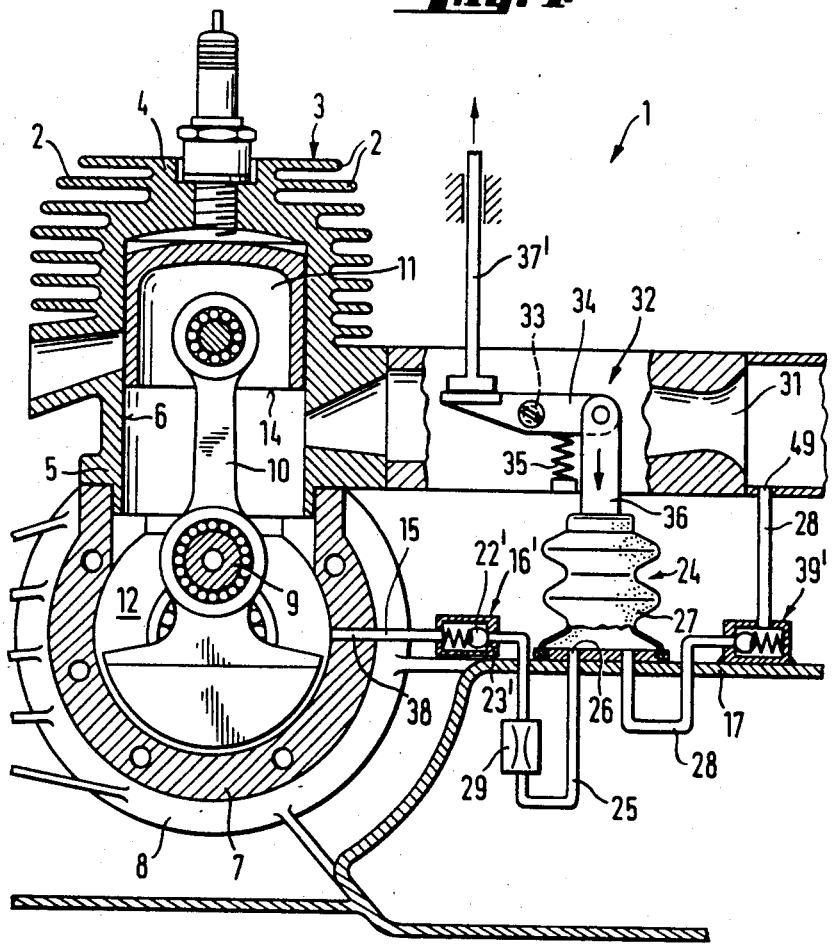
FIG. 4 is a side elevation view of the two-stroke engine of FIG. 2, with a pneumatic controlling member which, with the engine running, is continuously exposed to vacuum in the direction of full load.

The embodiment illustrated in FIG. 4 corresponds largely to the embodiment of FIG. 2 so that corresponding parts carrying identical reference numerals will not be described again in the following. However, a substantial difference to the embodiments previously described is that, with the engine running, the pneumatic controlling member 24 is continuously exposed to underpressure and that tie rod 37' of output actuator 32 is thereby shifted in the direction of full load as indicated by the arrow above tie rod 37', in opposition to the force of spring 35.

For this purpose, control line 25 connecting inner chamber 12 of crankcase 8 with pneumatic controlling member 24 accommodates a control valve 16' adapted to open only in response to underpressure waves in crankcase 8. This underpressure causes contraction of pneumatic controlling member 24 which is a bellows. Even at high engine speeds, valve 16' is completely independent of, and thus not affected by, the vibrating motions of crankcase 8. Valve 16', which in this embodiment is configured as a ball check valve and may also be a mushroom valve, opens only in the one direction in response to underpressure, while inhibiting passage in the presence of overpressure. For the overpressure condition, the ball-shaped sealing member 22' will engage valve seat 23' as shown. In addition, control line 25 also accommodates air-flow throttle 29 which is arranged between valve 16' and pneumatic controlling member 24.

Moreover, pneumatic controlling member 24 is connected to a control valve 39' for ventilation purposes. Control valve 39' is arranged in vent line 28 which opens into the pneumatic controlling member 24. In this embodiment, intake opening 49 of vent line 28 is in the lower region in front of carburetor venturi 31. Control valve 39' is configured as a spring-loaded ball valve similar to valve 16'; however, the control valve 39' is opened by means of vibrating motions which are dependent on the engine speed. Therefore, control valve 39' is fixedly connected to crankcase 8.

With two-stroke engine 1 running, an underpressure is produced in pneumatic controlling member 24 through pressure line 15, control valve 16' and throttle 29 of control line 25. With control valve 39' in the closed position, pneumatic controlling member 24 is thus continuously exposed to underpressure with the engine running and pulls throttle flap control lever 34 in the direction of full load (arrow) in opposition to the force of spring 35.

When the control speed is reached, control valve 39' will open. This causes the underpressure in pneumatic controlling member 24 to break down, as a result of which the latter is moved in the idling direction (against the direction of the arrow shown on connecting member 36) by spring 35. With the rotational speed decreasing, control valve 39' will again close, and an underpressure will again be built up in the pneumatic controlling member 24, so that output actuator 32 pulls or moves the throttle flap in the direction of full load.

Throttle 29 assists the breakdown of the underpressure with control valve 39' open. The operator opens the throttle flap as a result of tie rod 37' yielding to the pull of pneumatic controlling member 24 at low engine speeds. The throttle flap is closed by expanding the bellows or pneumatic controlling member 24 in opposition to the generally existing underpressure. Instead of a tie rod, a pre-tension spring stronger than spring 35 may be used to close the throttle flap with the bellows in the contracted position, this being accomplished by the spring taking up the length of the closing stroke.

It is a significant advantage of this speed control system that it avoids running up of the two-stroke engine 1 also in the event of a damage to the bellows or pneumatic controlling mcmber 24, the lines, the control apparatus, the control valve 16' or the control valve 39', because in these cases no underpressure is available for opening or adjusting the position of the throttle flap in the direction of full load.

Figure 5:
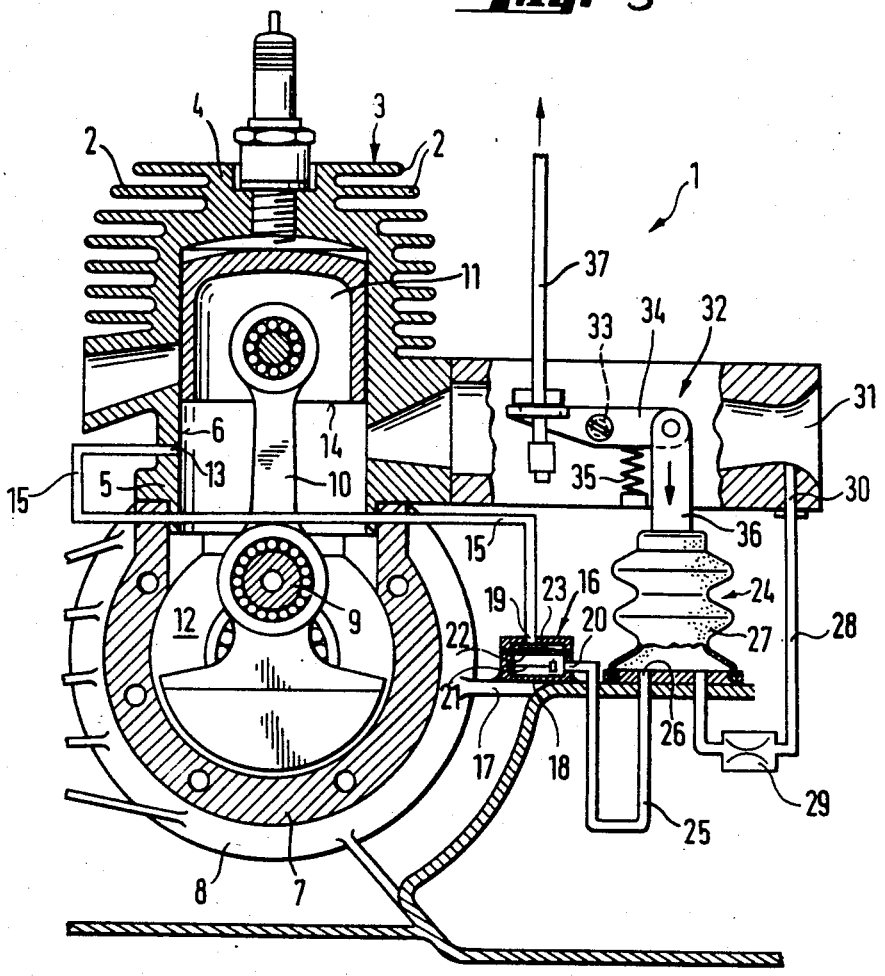
FIG. 5 is a side elevation view, in section, of a two-stroke engine of the invention with a frequency-dependent speed-control apparatus; and, FIG. 6 is an enlarged side elevation view, in section, of a resonance control valve for controlling the rotational speed of the two-stroke engine of FIG. 5.
Figure 6:
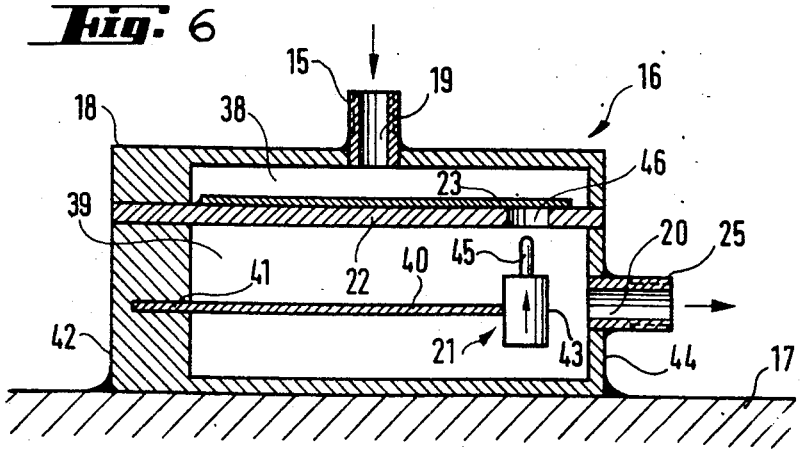

The description which follows refers to FIGS. 5 and 6.

The embodiment of the two-stroke engine of the invention shown in FIGS. 5 and 6 includes a cylinder 3 provided with cooling ribs 2. The cylinder head 4 connects with the lower part 5 of the wall 6 at the end remote from the cylinder head 4 with a wall 7 of the crankcase 8. A crankshaft 9 is adapted to revolve in bearings in the crankcase 8. Coupled to the crankshaft 9 is a connecting rod 10 with a reciprocating piston 11.

In the embodiment shown, the piston 11 is at top dead center. The reciprocating motion of the piston 11 produces different pressure waves in the inner chamber 12 of the crankcase 8, with underpressure alternating with overpressure.

In the lower part 5 of the wall 6 of the cylinder 3, a bore 13 is provided which is positioned such that it is overtraveled by the piston 11 when the piston is at top dead center as shown. With the piston 11 in this position, its bottom edge 14 is thus above the bore 13, so that the bore is open to communicate with the inner chamber 12 of the crankcase 8.

A pressure line 15 extends to a resonance control valve 16 from the bore 13 of the cylinder 3. This resonance control valve 16 is fastened to a bracket 17 (welded connection) which in turn is directly formed fast with the wall 7 of the crankcase 8. As a result of this fast connection, the vibrations occurring in the engine or the crankcase 8 are directly transmitted to the resonance control valve 16 and cause the valve to open at an accurately predeterminable resonance frequency or acceleration amplitude.

The resonance control valve 16 has a housing 18 with an inlet port 19 and an outlet port 20. The housing 18 accommodates a mass oscillator 21 which is movable against a sealing diaphragm 23 through a partition wall 22. The pressure line 15 which is configured as a hollow line is connected to the inlet port 19 of the valve housing 18.

A pneumatic control member 24 which responds to underpressure is connected to the resonance control valve 16 via a control line 25. In this arrangement, the control line 25 extends from the outlet port 20 of the resonance control valve 16 to the inlet port 26 of the pneumatic control member 24. The pneumatic control member 24 is preferably a bellows 27 and may be made of rubber or plastic. Instead of being configured as a bellows, the pneumatic control member 24 may also be a piston and cylinder assembly, for example, in which the piston is axially displaced in the pneumatic cylinder when a change in pressure occurs.

In addition, a ventilation line 28 including an air-flow throttle 29 is connected to the pneumatic control member 24. The other end of ventilation line 28 is connected to a transverse bore 30 of a carburetor venturi 31. The bellows 27 connects the ventilation line 28 with the control line 25.

At the opposite upper end of the bellows 27 is an output member 32 which is preferably configured as a throttle-flap lever 34 pivotable about a pin 33. The throttle-flap lever cooperates with a spring 35 which acts in the opening direction of the throttle flap (not shown) of a carburetor (not shown). One end of the throttle-flap lever 34 is pivotally connected to the bellows 27 via a connecting lever 36 which extends at substantially right angles to lever 34. At the other end of the throttle-flap lever 34, a tie rod 37 is provided for manual operation of the throttle valve. The throttle flap closes when the bellows 27 is pressed together and the tie rod 37 is actuated upwardly in the direction of the arrow. If the tie rod 37 is actuated downwardly in the opposite direction, the throttle flap is released and opened by the force of the spring element 35.

FIG. 6 shows that the housing 18 of the resonance control valve 16 has two chambers, that is, an inlet chamber 38 and an outlet chamber 39 which are separated from each other by the partition wall 22. The inlet chamber 38 in which the inlet port 19 for the pressure line 15 is provided is substantially smaller than the outlet chamber 39 the outlet port 20 of which is connected to the control line 25 leading to the pneumatic control member 24.

The mass oscillator 21 provided in the outlet chamber 39 is approximately configured in the manner of a pendulum and possesses an inherently rigid resilient body 40 which is preferably configured as a flat rectangular leaf spring or a spring steel wire. One end 41 of the spring body 40 is fixedly mounted in the left-hand wall 42 of the housing 18 as shown. The spring body 40 is mounted in the outlet chamber 39 such that it extends approximately into the mid-region thereof parallel to the partition wall 22. A flyweight 43 is mounted on the free end of the resilient body 40 remote from the secured end 41. The flyweight 43 is arranged in the proximity of the right-hand wall 44 of the housing 18 as shown. The flyweight 43 has a pin-shaped actuating member 45 which extends normal to the plane of the resilient body 40 and is arranged so as to swing into a pass-through opening 46 in the partition wall 22 when the mass oscllator 21 has reached a specific resonance frequency.

The sealing diaphragm 23 in the inlet chamber 38 of the housing 18 can preferably be made of a thin metal sheet, for example, a high-quality stainless steel. The sealing diaphragm seal 23 is fastened on one side and lies directly on the partition wall 22 and covers the pass-through opening 46. The sealing diaphragm is adapted to be lifted clear of the partition wall 22 in the region of the pass-through opening 46. This is the condition when the actuating member 45 of the mass oscillator 21 swings into the pass-through opening 46 and abuts against the sealing diaphragm 23 thereby opening the pass-through opening 46 for a short time.

Particularly with respect to its geometry, the mass oscillator 21, with its one end fixedly mounted in the wall 42, is configured such that its resonance frequency is at a few revolutions above the desired control speed of the two-stroke engine 1. By closing the pass-through opening 46, the sealing diaphragm 23, which is likewise preferably secured at one end, allows no communication with the inner chamber of the bellows 27. The resonance control valve 16 is activated by the fundamental frequency of the engine for which purpose it is formed fast with the engine system by means of the bracket 17. Already at a few revolutions before the actual resonance frequency, the amplification of the excited amplitude is so high that the mass oscillator 21 with the actuating member 45 enters the pass-through opening 46 and opens the sealing diaphragm 23 once for every oscillation. An essential advantage of the resonance control valve 16 is that it can supply a precisely defined, unambiguous signal for the speed control, which signal is almost independent of the magnitude of the activating acceleration.

In the two-stroke engine 1, an underpressure exists during the entire time that the bore 13 is open; with the engine running, this underpressure is also present in the pressure line 15 leading to the resonance control valve 16. If the rotational speed of the two-stroke engine 1 becomes too high, oscillation frequencies occur at the resonance control valve 16 such that the mass oscillator 21 unseats the sealing diaphragm 23 from the pass-through opening 46. In this way, the pressure line 15 and the control line 25 are connected with each other. Thus, the underpressure will in this way also build up in the control line 25 and in the bellows 27 which will thereby contract and move the throttle-flap lever 34 in the closing direction of the throttle flap.

After the rotational speed of the two-stroke engine 1 is correspondingly reduced, the amplitude of oscillation of the mass oscillator 21 will become less so that the sealing diaphragm 23 will again close the pass-through opening 46. With the resonance control valve 16 closed, air will be admitted into the bellows 27 through the air-flow throttle 29 thereby causing the bellows 27 to expand again and correspondingly open the throttle flap.

The air-flow throttle 29 is configured such that, with the resonance control valve 16 open, it does not impair the buildup of underpressure in the bellows 27. The bellows 27 is ventilated through the transverse bore 30 in the carburetor venturi 31. As a result, on commencement of the control function, when the throttle flap is still open and the underpressure in the crankcase 8 is still low, a pre-underpressure will be produced in the air-flow throttle 29 because of the air inducted at high velocity in the carburetor venturi 31. This pre-underpressure which is provided through the ventilation line 28 and the air-flow throttle 29, supports the formation of underpressure in the bellows 27.

It is understood that the foregoing description is that of the preferred embodiments of the invention and that various changes and modifications may be made thereto without departing from the spirit and scope of the invention as defined in the appended claims.

What is claimed is:

1. A two-stroke engine equipped with a control device to control an operating condition of the engine, the engine comprising:

a crankcase subjected to continuously alternating underpressure and overpressure conditions;

an output actuator connected to said control device for adjusting said operating condition;

pneumatic actuating means responsive to a change in pressure therein for acting on said output actuator so as to cause the latter to adjust said control device to control said operating condition;

pressure connecting means for connecting said pneumatic actuating means to said crankcase; and, resonance valve means connected into said pressure connecting means for opening the latter in response to a predetermined resonance frequency thereby subjecting said pneumatic actuating means to one of said pressure conditions and causing a pressure change therein.

2. A two-stroke engine having a predetermined resonance frequency and being equipped with a carburetor controlled by a throttle flap, the engine comprising:

a crankcase subjected to continuously alternating underpressure and overpressure conditions;

an output actuator connected to said throttle flap of the engine for adjusting the speed thereof;

pneumatic actuating means responsive to a change in pressure therein for acting on said output actuator so as to cause the latter to adjust the position of said throttle flap thereby changing the speed of the engine;

pressure conduit means for connecting said pneumatic actuating means to said crankcase; and, resonance valve means connected into said pressure conduit means for opening the latter in response to a predetermined resonance frequency thereby subjecting said pneumatic actuating means to one of said pressure conditions and causing a pressure change therein.

3. The two-stroke engine of claim 2, said resonance valve means comprising:

a housing fixedly connected to said crankcase for sensing said resonance frequency;

pass-through opening means for defining a pass-through opening in said pressure conduit means;

sealing membrane means mounted so as to displaceably lie over said pass-through opening means for closing off the same in the rest position thereof; and, mass oscillator means mounted in said housing for displacing said sealing membrane means in response to said resonance frequency thereby opening said pass-through opening.

4. The two-stroke engine of claim 3, said pass-through opening means being a partition wall having said pass-through opening formed therein, said partition wall defining said pass-through opening and being disposed in said housing for partitioning said housing into an inlet chamber having an inlet opening and an outlet chamber having an outlet opening; said pressure conduit means including a first conduit connecting said crankcase to said inlet opening of said inlet chamber and a second conduit connecting said outlet opening of said outlet chamber to said pneumatic actuating means; and, said sealing membrane means being a sealing membrane mounted on said partition wall in said inlet chamber so as to cover said pass-through opening in the rest position thereof.

5. The two-stroke engine of claim 4, said sealing membrane being made of a thin metal plate.

6. The two-stroke engine of claim 5, said mass oscillator means being mounted in said outlet chamber and having an actuating portion for passing through said pass-through opening and striking said sealing membrane so as to displace the same away from said pass-through opening thereby causing said crankcase to be in direct communication with said pneumatic actuating means.

7. The two-stroke engine of claim 6, said mass oscillating means being configured as a pendulum having a stem and flyweight mounted at the free end thereof, the other end of said stem being cantilevered in a wall of said housing, said stem being a resilient rod-like body.

8. The two-stroke engine of claim 7, said stem being cantilevered in said wall so as to be parallel to said partition wall, said housing having another wall disposed so as to be opposite to said first-mentioned wall, said pass-through opening, and said flyweight and said actuating portion thereof being disposed near said other wall.

9. The two-stroke engine of claim 3, said crankcase having a bracket formed thereon, said housing being mounted on said bracket.

* * * * *